United States Patent [19]

Minkow et al.

[11] Patent Number: 4,711,448

[45] Date of Patent: Dec. 8, 1987

[54] LOWER BODY EXERCISING AND WEIGHT TRAINING DEVICE

[76] Inventors: Roger E. Minkow, 735 H St., Petaluma, Calif. 94952; Julius M. Minkow, 69 Washington St., Brooklyn 1, N.Y. 11201

[21] Appl. No.: 722,226

[22] Filed: Apr. 11, 1985

[51] Int. Cl.[4] ..... A63B 21/06

[52] U.S. Cl. ..... 272/118; 272/134; 272/DIG. 4

[58] Field of Search ..... 272/118, 117, 143, 134, 272/DIG. 4, 93, 144, 67, 132, 140, 901

[56] References Cited

U.S. PATENT DOCUMENTS

| | | | |
|---|---|---|---|
| 2,777,439 | 1/1957 | Tuttle | 272/132 X |
| 3,721,438 | 3/1973 | Kusmer | 272/132 X |
| 3,727,913 | 4/1973 | Glaser et al. | 272/DIG. 4 X |
| 4,200,279 | 4/1980 | Lambert | 272/118 |
| 4,240,626 | 12/1980 | Lambert | 272/118 |
| 4,256,302 | 3/1981 | Keiser et al. | 272/118 |
| 4,358,108 | 11/1982 | Voris | 272/118 |
| 4,387,893 | 6/1983 | Baldwin | 272/118 |
| 4,500,089 | 2/1985 | Jones | 272/118 X |
| 4,505,475 | 3/1985 | Olschansky et al. | 272/118 |
| 4,531,730 | 7/1985 | Chenera | 272/144 |
| 4,600,189 | 7/1986 | Olschansky et al. | 272/118 |
| 4,611,807 | 9/1986 | Castillo | 272/132 |
| 4,621,807 | 11/1986 | Stramer | 272/117 |

*Primary Examiner*—Richard J. Apley
*Assistant Examiner*—Robert W. Bahr
*Attorney, Agent, or Firm*—George W. Wasson

[57] ABSTRACT

An apparatus for use in exercising selected lower body muscles and joints of a user's body. The apparatus is adjustable to accommodate users of various sizes and dimensions. The machine comprises a frame including a base and support members fixed to said base, a resistance mechanism providing an adjustable resistance force to a fixed location on the support members, and a movable portion for transferring the adjustable resistance force to user elements. The movable portion includes adjustable elements for positioning the movable portions with respect to the base and the support members, and for adapting the apparatus for exercises requiring forces in either clockwise or counterclockwise rotational movements to permit exercise of selected muscles and joints by movement of the resistance mechanism. A bench surface is supported on the frame in a manner to be positioned in an "in use" or a "storage" position.

10 Claims, 9 Drawing Figures

LOWER BODY EXERCISING AND WEIGHT TRAINING DEVICE

FIELD OF THE INVENTION

The present invention relates to a device useful in exercising human body members and in weight training for improving physical condition and muscular strength without excessive strain on body muscles and particularly without strain on the human back. The device has particular usefulness in strengthening lower body muscles generally those muscles below the waist and including hip and leg joints and muscles.

BACKGROUND OF THE INVENTION

Exercising apparatus employing weight displacement means connected to cables are known and apparatus programed to exercise specific muscles are known. Many of such apparatus have been installed in weight training rooms and are available at athletic clubs and facilities. With many of the prior art apparatus the user stands in front of the apparatus and pulls cables connected to the weight displacement means or sits on a bench to engage elaborate programed apparatus to exercise the desired muscles. "Station" weight machines, most of which use cams or levers connected to weights, are not adapted to provide for use by all sizes of users in that the cables connected to the weights are usually at some fixed position and are not adjustable for variations in the height or size of the user. The same disadvantage applies to the apparatus employing a bench in that the user must fit into the apparatus rather than have the apparatus adjustable to the user.

It is an object of the present invention to provide an exercise apparatus using cables and weights that will be useful to any size of user in that the user and the particular muscle or joint being exercised is always aligned with the cable pull system regardless of the size of the user.

It is a further object of the present invention to provide an exercise apparatus that will permit exercise of particularly the lower body muscles of the user in a manner to provide matching of the machine to the user to accomplish maximum benefits and comfort to the user.

The foregoing and other objects of the present invention will be readily apparent to those skilled in the art from the appended drawings and specification illustrating a preferred embodiment wherein.

Figure 1:
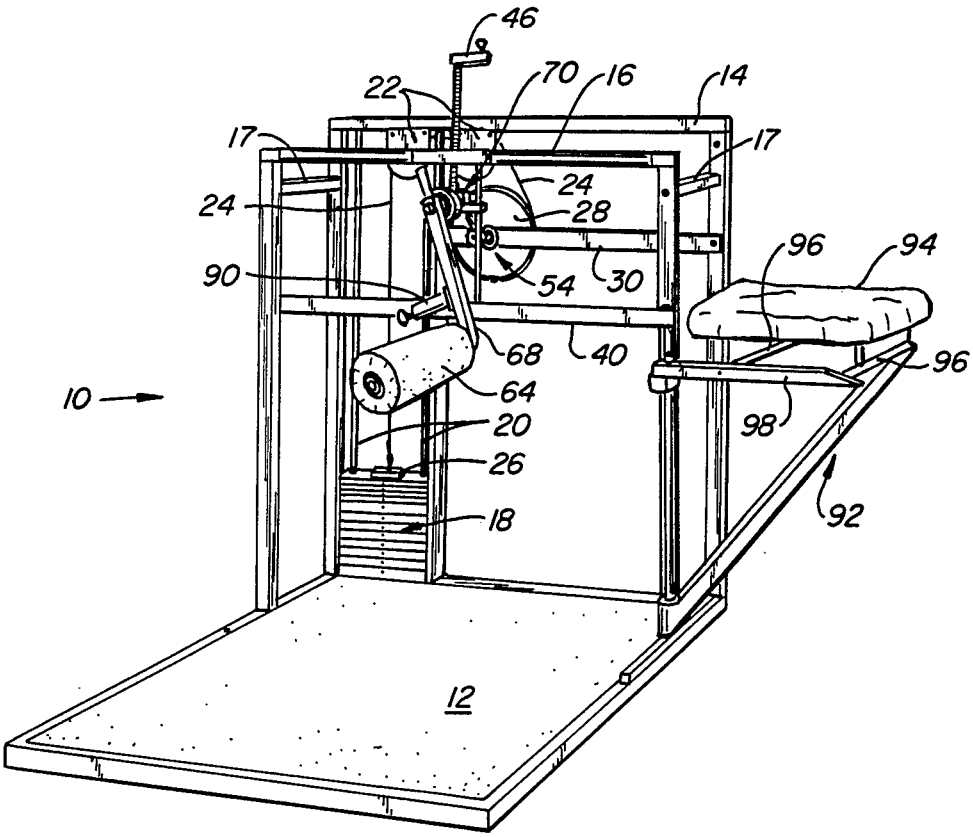
FIG. 1 is a perspective view of the apparatus in its assembled form.

The exercise machine 10 of the present invention comprises a frame assembly including a base 12, a first upright vertical support member 14 and a second upright vertical support member 16. The first and second support members are horizontally seperated a fixed distance by braces 17 near their top ends and are fixed at their lower ends to the base member in a manner to be parallel to each other and perpendicular to the base. An adjustable set of gravity responsive weight elements 18 are mounted within the first support member 14 and guided on a pair of guide bars 20. Associated with the weight elements is a pulley set 22 and a cable 24. The cable 24 is attached at one end to the top element 26 of the weight set, used to connect the weights in adjustable sets, and at the other end to the perimeter of a wheel 28 rotatably supported on a cross brace 30 on the first support member 16. The axis of rotatable support of the wheel 28 on cross brace 30 establishes the fixed location rotatable shaft 32 on the first support element 14 of the exercise machine.

The wheel 28 is preferrably formed with an external groove to accommodate the cable 24 at the circumference of the wheel. In this manner the force contact between the wheel and the cable 24 is always along a tangent from the wheel.

Figure 2A:
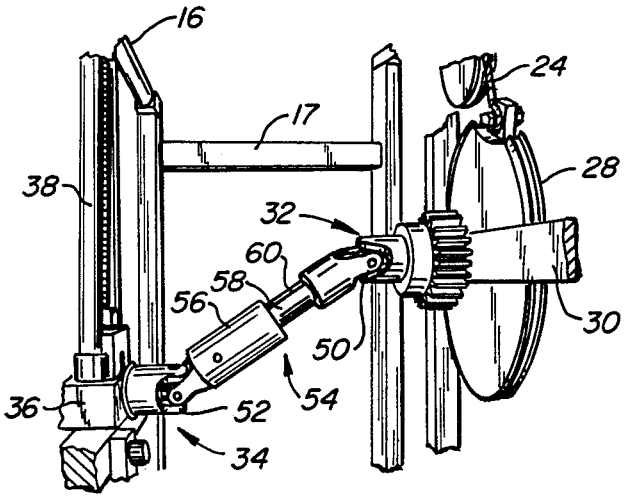
FIG. 2A is a partial perspective view of the interconnection between the fixed location rotatable shaft and the movable rotatable shaft.
Figure 2B:
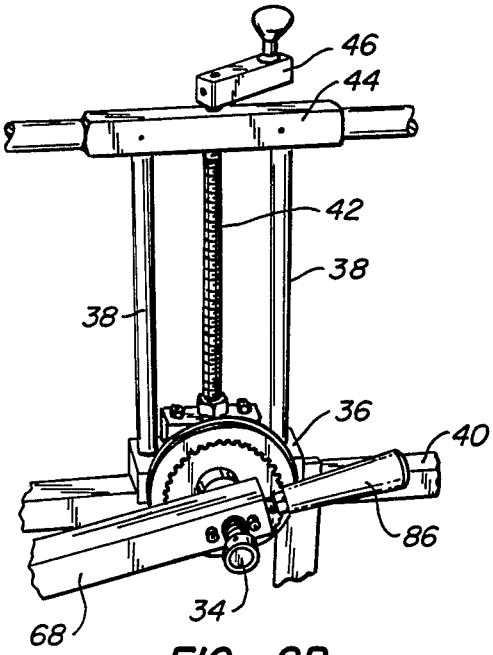
FIG. 2B is a partial perspective view of the adjustable support for vertical movement of the movable rotatable shaft.

The machine user operable elements of the exercise machine are adjustably and movably supported on the second support element 16. The first portion of the machine user operable elements, as shown in FIG. 2A, comprises a means movable in a vertical direction to establish a movable rotatable shaft 34 mounted within the second support member 16. The movable rotatable shaft 34 is journaled in a movable block member 36 mounted for sliding movement along a pair of guide bars 38 between a brace 40 and the top of the support member 16. An elongated threaded shaft 42 is rotatably journaled in the block member 36 between the guide bars 38 at its lower end and at its upper end is threaded through a taped hole passing through a portion 44 of the top of support member 16 at its upper end. An operating arm and handle 46 are attached to the upper end of the threaded shaft 42 to provide for rotation of the shaft thus effecting vertical movement of the block member 36 up or down along the guide bars 38.

A flexible mechanical connection is provided between the fixed location rotatable shaft 32 and the movable rotatable shaft 34 as shown in FIG. 2A. The flexible mechanical connection comprises a first universal joint 50 mounted to the rotatable shaft 32, a second universal joint 52 mounted to the movable shaft 34 and an axially sliding connection 54 between the two universal joints. The sliding connection includes an outer hollow member 56 and an inner member 58 with a sliding, but positive, connection between the outer and inner members, such as by a key and key-way connection 60, or the like. This flexible mechanical connection between the shafts 32 and 34 permits the shaft 34 to be raised and lowered within the second support member 16 while the shaft 32 is maintained in a fixed position within the first support member 14. The connection also permits the equivalent of shaft 32 to be movable horizontally along the brace 30, for a purpose that will be further described hereinafter, without interfering with the flexible mechanical connection between the two shafts.

The flexible mechanical connection may be directly connected to the fixed location rotatable shaft 32 or may be connected through a gear set 62 including a first gear on shaft 3 and a second gear mounted on cross brace 30 for rotation from a fixed location on the support member 14. The gear set is shown in FIG. 2E illustrating the movement of the fixed location rotatable shaft 32 horizontally along the cross brace. With the gear set as illustrated it is possible to vary the mechanical ratio between the rotation of the movable rotatable shaft 34 and the fixed location rotatable shaft 32 to permit the user of the exercise machine to control the resistance level of the machine.

The adjustable elements of the exercise machine include additional adjustments for radial and rotational location of the user elements of the machine. As illustrated in FIG. 2D, the user elements include a padded bar 64 supported on a shaft 66 adjustably positionable along an arm 68 mounted for rotation with an extension of movable rotatable shaft 34 and connected to the rotatable shaft by an adjustable connection 70.

Figure 3B:
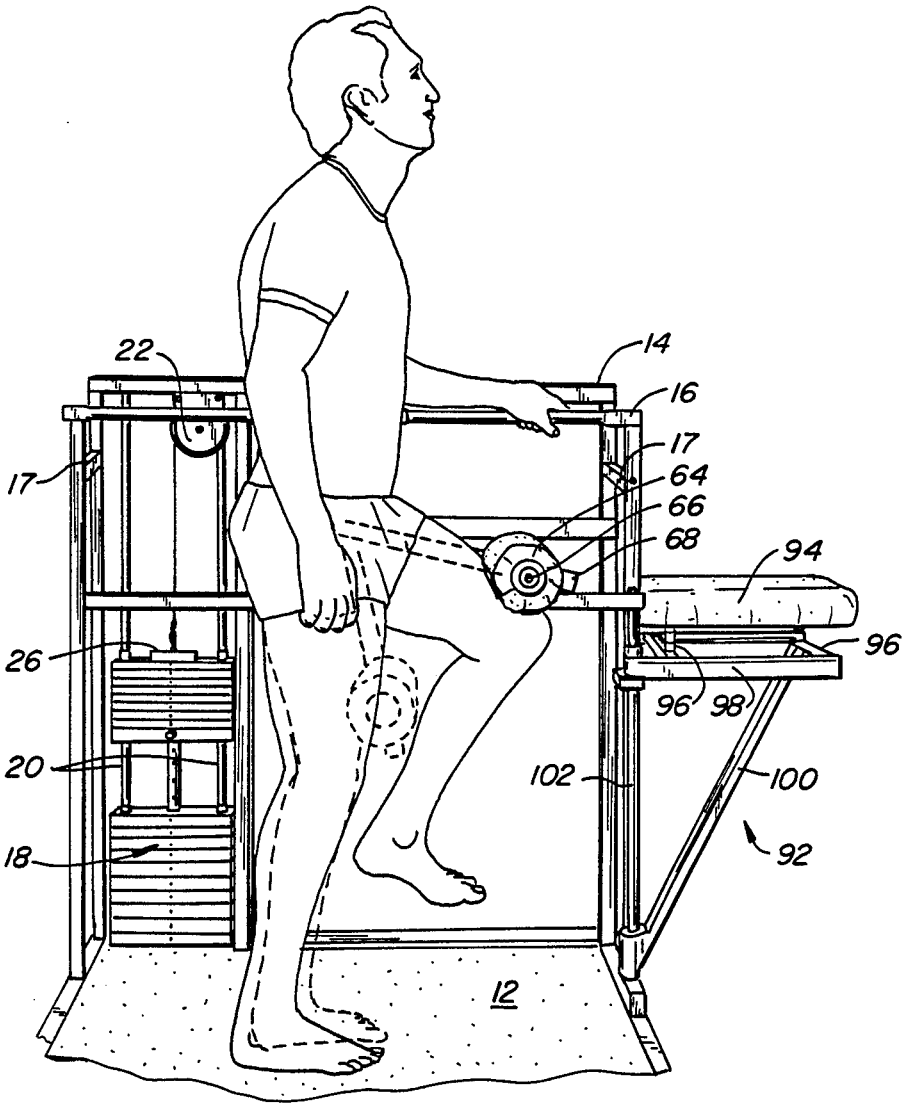
FIG. 3B is a perspective view illustrating the use of the machine for the exercise of leg and thigh muscles and hip joints and illustrating the bench in stored position.
Figure 3A:
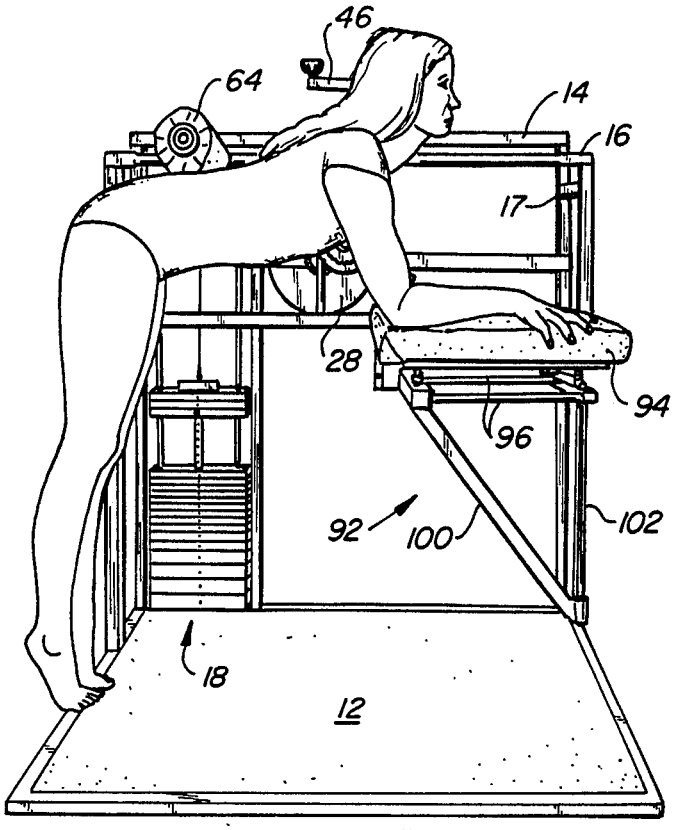
FIG. 3A is a perspective view illustrating the use of the machine with the bench in use for the exercise of lower leg muscles and joints.
Figure 3C:
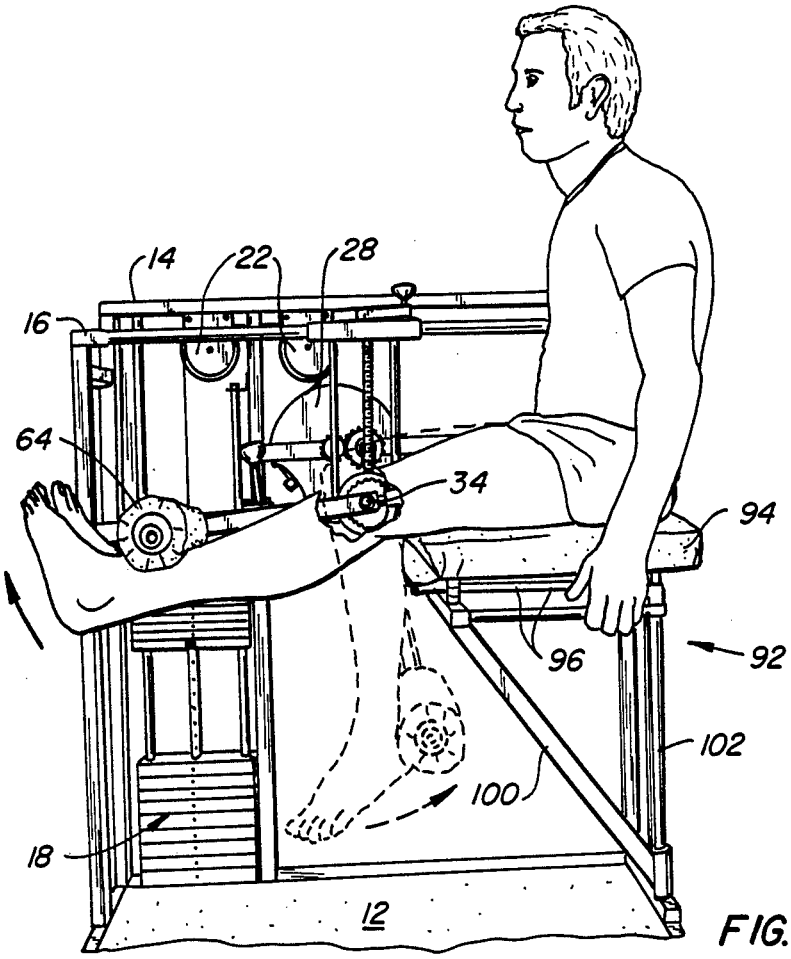
FIG. 3C is a perspective view illustrating the use of the machine with the bench for the exercise of lower leg muscles in either of two alternative rotational directions.

The rotational adjustment of the user elements is accomplished by the adjustable connection 70 comprising a spline gear assembly as shown in FIG. 3C. The spline gear assembly comprises an outer spline element 72 fixed by suitable means to the movable rotatable shaft 34 on the side of the movable block member opposite to the side where the second universal joint 52 is connected. The outer spline element 72 has an internal set of spline gear teeth 74. Slideably mounted for axial movement along the shaft 34 is an inner spline element 76 having an external set of spline gear teeth 78 that are engagable with the internal set of spline gear teeth 74. Arm 68 is fixed to the inner spline element 76, by means not shown, at a shoulder 80 thereon so as to be slideable axially along shaft 34 with the inner spline element. A biasing spring 82 is mounted about shaft 34 and operates between the arm 68 and an end cap 84 fixed to the end of shaft 34. The spring biases the inner spline element 76 into the outer spline element 72 when the spline gear teeth 74 and 78 are properly aligned. A handle 86 is mounted on a portion of arm 68 opposite to the side supporting the user element 64 as an assist for sliding the arm and inner spline element along shaft 34.

Figure 2C:
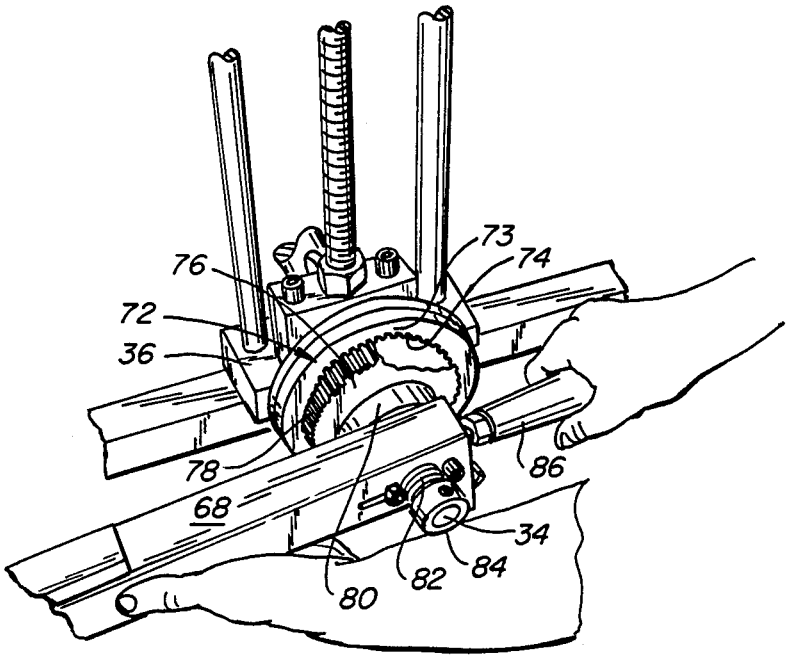
FIG. 2C is a partial perspective view of the angular adjustment means for the user element mounted on the movable rotatable shaft.
Figure 2D:
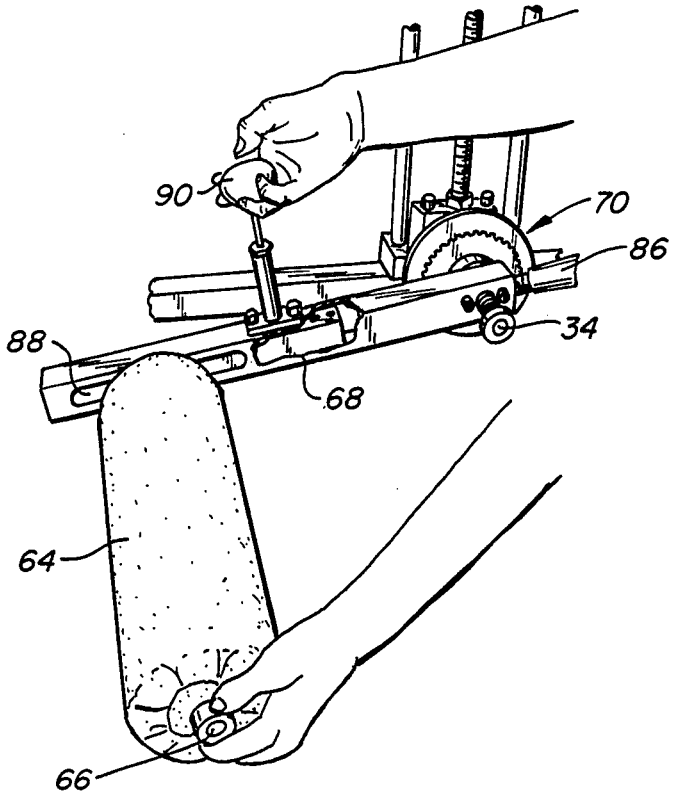
FIG. 2D is a partial perspective view of the radial adjustment means for the user element mounted to the movable rotatable shaft.
Figure 2E:
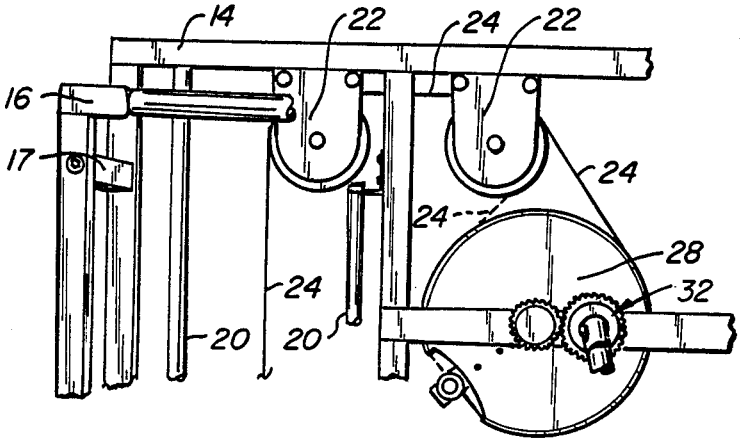
FIG. 2E is a partial front elevational view of the fixed location rotatable shaft illustrating the alternative positions of the connection between an element connected to that shaft and the weight elements of the exercise machine.

As shown in FIG. 2C the arm 68 is positionable in an angular relationship to shaft 34 by pulling the shaft outwardly with respect to the block 36 and outer spline element 72 against the bias of spring 82, then rotating the arm 68 and inner spline element 76 around shaft 34 to a desired angular position, and then returning the inner spline element into engagement with the outer spline element. The angular adjustment of the user element with this adjustment means is in a plane parallel to the plane of the frame elements.

Radial adjustment of the user elements is accomplished by the adjustable positioning of the user element along the arm 68. As shown in FIG. 2D the shaft 66 supporting the padded bar 64 is mounted to an member 88 slideably supported within the arm 68. The arm 68, in the form illustrated, is a hollow member with a square cross-section and the member 88 within the arm 68 has the same form of cross-section to permit the slideable adjustment of the members. A locking mechanism 90 is provided to lock the inner member in its adjusted position and, as shown in FIG. 2D, the locking mechanism may be a pin that is engagable with cut-out portions in the inner member. The pin is preferably spring biased to lock the pin into the cut-out portions in a manner that should be easily understood.

As illustrated in FIG. 2D the radial adjustment of the user element along the arm 68 is accomplished by releasing the locking mechanism 90 from its engagement with the inner member 88 and moving the padded bar 64 toward or away from the shaft 34 to a desired position and then releasing the spring biased locking mechanism to secure the position of the pad. The radial adjustment of the user elements with this adjustment means positions the user elements along a lever arm in a plane parallel to the plane of the frame elements.

The apparatus thus described provides a mechanism that will convert rotary motion of a movable shaft to vertical movement of a set of resistance elements in the form of weight elements. The means providing the rotary motion is the user element padded bar 64 for moving the arm 68 and the shaft 34 in a rotary manner. The universal joint and sliding connection between shaft 34 and shaft 32 transfers the rotary motion to the wheel 28 to cause movement of the cable 24 through the pulley set 22 and thus vertical movement of the weight set elements 18. In some uses of an exercise machine of the type herein illustrated it is desireable to change the operation of the mechanism to provide resistance force against clockwise rotation of a shaft in some exercises and to provide resistance force against counterclockwise rotation in other exercises. The apparatus of the present invention permits such a change in operation by providing means for positioning the cable connection between the cable 24 and the wheel 28.

As shown in FIG. 1 the rotation of the wheel 28 in a clockwise direction will cause the weights 18 to be raised thus providing the desired resistance and machine use. When positioned as shown in that view, rotation of the wheel 28 in a counter-clockwise direction will not provide a weight resistance and thus no exercise value. If the wheel 28 is rotated to the position as shown in FIG. 2E so that the connection between the cable 24 and the wheel is on the opposite side from that shown in FIG. 1, the rotation of the wheel in a counterclockwise direction will cause the weights 18 to be raised thus providing the desired resistance and machine use. When positioned as shown in FIG. 2E, rotation of the wheel in a clockwise direction will not provide a weight resistance and thus no exercise value.

The positioning of the wheel 28 and the adjustment of the user elements to accomplish the selective conversion of the rotary movement from clockwise to counterclockwise is accomplished by first positioning the cable-wheel connection in either the FIG. 1 or FIG. 2E position. That positioning is accomplished by rotating the fixed location rotatable shaft 32 to position the cable-wheel connection by rotation of the movable rotatable shaft 34 by movement of the arm 68. After the cable-wheel connection is positioned, the arm 68 may be angularly positioned with respect to the shaft 34 to place the padded bar 64 in the desired position. With the cable-wheel connection and the arm positioned as desired the top element 26 of the weight set 18 may be connected to the desired weight combination and a rotation of the user elements will cause weight resistance to be transferred to the user elements. The adjustable connection 70 employing the spline gear set permits the arm 68 to be positioned in small increments (such as increments of 5 degrees) at any angular position around shaft 34. Rotational movement of the arm 68 around the axis of the shaft 34 causes vertical movement of the weight set 18 along the guide bars 20. When the cable-wheel connection and the arm-shaft position are adjusted as desired and selected by the machine user, the will be a constant mechanical resistance or advantage between rotation of the shaft 34 and lifting the weights 18 because the cable will always be contacting the wheel at its circumference and the force connection between the wheel and the cable will always be tangential. The mechanical relationship between the cable and wheel will be the resistance force of the weight set 18 and the radius of the wheel 28. The radial position of the padded bar along the arm 68 will also establish a lever arm mechanical relationship between the force needed to move the weight set within the machine. If it is desired to change the gear ratio between the rotation of the shaft 34 and the shaft 32, there is the availability of changing the gear set 62. With shaft 34 directly connectd to shaft 32 there is direct drive. If a gear is inserted between the two shafts the ratio of rotation between the shafts may be increased or decreased as desired to increase or decrease the force that must be supplied at the shaft 34 to raise the weight set 18.

An additional feature of the exercise machine of the present invention is the bench or seat assembly 92 shown in stored position in FIG. 1 and 3B and in used position in FIG. 3A and 3C. The bench comprises a padded seat element 94 with a frame portion 96 fixed to an upper support arm 98 and a diagonal brace 100. The upper support arm 98 is rotatably journaled on an upright portion 102 of the second upright vertical support member 16 at a shoulder thereon. The diagonal brace is also rotatably journaled on the upright portion 102 at the base thereof. With these two rotatable journals the bench assembly 92 may be rotated to a stored position adjacent to the two support members 14 and 16 or may be rotated to an in use position in front of the second member 16. A suitable latch mechanism is provided on a portion of the frame to permit the assembly to be securely fixed to the support member 16 when in the in use position. The bench assembly provides a seat or bench at a fixed height when in the in use position but the adjustable features of the user elements of the exercise machine permits the user of the machine to position the user elements in a desired or preferred position.

FIGS. 3A, 3B and 3C illustrate the exercise machine in use for specific exercises and illustrate the adjustable features of the apparatus of the present invention. Referring first to FIG. 3A, the user is here shown using the machine for the exercise of leg and hip joints and muscles. The arrangement of the bench assembly 92 in the position shown permits the user to lean against the padded seat 94 and to perform calf raise exercises and squat exercises with the effect of the weights supported on the hips of the user instead of on the shoulders. Support of the weight on the hips eliminates lower back strain and potential spinal disc herniation. The user has adjusted the height and radial position of the padded bar 64 to a position that coincides with the size of the user. As shown in this FIG. in dotted lines, the position of the movable shaft 34 above the base 12 is substantially aligned with the hip joint of the user. The rotational position of the arm 68 is then positioned to accommodate the desired exercise activity.

FIG. 3B illustrates the exercise machine used for exercises of the hip joint and thigh muscles. As here illustrated the bench assembly is rotated to its stored position and the user is standing in front of the machine. The vertical position of the shaft 34 has been adjusted to align the shaft with the user's hip joint. The radial position of the padded bar 64 along the arm 68 has been positioned to place the bar in alignment with the upper knee area of the user. The cable-wheel position, not here illustrated, has been adjusted to establish the desired rotational relationship between the exercise and the weight set. As illustrated in full lines, the user may exercise the leg and hip closest to the support member 16; the dotted line illustration represents the user exercising the other leg. It should be understood that the user may face in the opposite direction and may adjust the machine elements to perform exercises in the opposite direction. The user may also face the machine and position the bar leg and hip exercises rotating the legs parallel to the plane of the support members.

FIG. 3C illustrates the exercise machine used for exercises of the lower leg and knee joints. The full line illustration of the user's legs illustrates the positioning of the wheel-cable system to provide for clockwise movement of the arm 68 to cause lifting of the weight set. The dotted line illustration of the user's legs illustrates the positioning of the wheel-cable system for counterclockwise movement of the arm 68 to cause lifting of the weight set. As illustrated the vertical position of the movable shaft 34 has been adjusted to align the shaft with the user's knee joint and the position of the padded bar 64 along the arm 68 has been positioned to place the bar in front of or behind the user's ankle. In this illustration the bench assembly is in front of the machine in locked position and the user is seated on the bench.

It should b understood that the position of the machine elements and the exercises illustrated are merely representative of the many other options available to the user. The adjustable features of the machine as illustrated provides an adjustable fulcrum for alignment with the user so that the machine may be used by the smallest as well as the largest individual with comfort and safety.

While a certain preferred embodiment of the invention has been specifically disclosed, it should be understood that the invention is not limited thereto as many variations will be readily apparent to those skilled in the art and the invention is to be given its broadest possible interpertation within the terms of the following claims.

We claim:

1. In a machine useable for exercising muscle and body joints the combination comprising:

(a) a frame including a base, a first and a second upright vertical support member, (b) an adjustable set of gravity responsive weight elements movable in a vertical direction within said first upright support member, (c) a rotatable shaft mounted at a fixed location on said first support member, and means connected to said shaft for converting rotary movement of said shaft to vertical movement of said weight elements, (d) a movable rotatable shaft mounted on said second of said support members, means for moving said movable shaft vertically within said second support memer, (e) machine user operable means adjustably supported on said movable rotatable shaft, said user operable means being adjustable in radial distance from said rotatable mounting of said rotatable shaft on said second support member, said adjustable support of said user operable means being rotatably adjustable to position said user operable means angularly about said movable rotatable shaft, (f) and a flexible positive mechanical connection between said fixed location of said rotatable shaft mounted on said first support member and said movable rotatable shaft mounted on said second support member, (g) said flexible position mechanical connection including:

(i) a universal joint connected to said rotatable shaft, (ii) a universal joint connected to said movable rotatable shaft, (iii) and an axially slideable positive connection between said universal joints, (h) said machine user operable means being adjustably positioned with respect to said second support member to provide vertical, rotary and radial adjustment of said user operable means, (i) and said machine user operable means being operable to adjust said flexible positive mechanical connection to said rotatable shaft to selectively cause vertical movement of said weight elements with either clockwise or counterclockwise rotation of said rotatable shaft mounted at said fixed location on said first support member.

2. The machine of claim 1 with the addition of a bench surface pivotally supported on said second of said upright support members, said bench surface being movable about said pivotal support to an "in use" position aligned with said second support member and said base member and to a "storage" position adjacent to said first and second support members and said base member.

3. The machine of claim 2 wherein said flexible connection between said fixed location rotatable shaft and said movable rotatable shaft comprises a pair of universal joints and a drive shaft including an axially slidable coupling.

4. A machine for use in exercising selected muscles and joints of a user's body including means for adjusting the relative position of user elements of said machine to accommodate users of various sizes or dimensions and for adapting said machine for exercises requiring forces in either clockwise or counterclockwise rotational directions, said machine comprising:

(a) frame elements including a base portion and support members fixed to said base portion, (b) a resistance mechanism slideably supported on said support members for vertical movement, a rotatable shaft mounted at a fixed location on said support members, and means connecting said resistance mechanism and said rotatable shaft and adapted to cause vertical movement of said resistance mechanism for providing an adjustable resistance force at said fixed location on said support members, said means connecting said resistance mechanism and said rotatable shaft including a cable and pulley system and an enlarged wheel connected to said rotatable shaft, said cable being attached at one end at a fixed location adjacent to the circumference of said wheel and at the other end through said pulley system to said resistance mechanism, the plane of rotation of said wheel and the plane of rotation of the last pulley of said pulley system being in the same plane and the rotation axis of said wheel and the rotation axis of said last pulley having a fixed relative location with respect to each other within said plane, said wheel being rotatable on its axis relative to said last pulley of said pulley system to position said attachment of said cable to said wheel at either side of a line between said rotation axis of said wheel and said rotation axis of said last pulley of said pulley system so as to permit said wheel to be rotated to a position to have said end of said cable contacting said wheel at a tangent to said wheel, and said wheel being rotatable in either a clockwise or a counterclockwise direction to cause said vertical movement of said resistance mechanism within said support members, (c) rotatable movable means supported on said support members and adjustably connected to said resistance mechanism at said fixed location for transfering said adjustable resistance force to said rotatable movable means and establishing an adjustable movable connection to said fixed location, (d) said rotatable movable means including adjustable elements for positioning said rotatable movable means with respect to said base portion and said support members, (e) and user elements connected to said rotatable movable means for engagement by a user of said machine to permit exercise of said selected muscles and joints by movement of said resistance mechanism through connection of said user elements to said fixed location from adjustable positions within said frame elements, said user elements including means for selectively setting said adjustable connection of said rotatable movable means to said resistance mechanism at said fixed location for clockwise or counterclockwise rotation of said movable mechanism to cause said vertical movement of said resistance mechanism.

5. The machine of claim 4 wherein said rotatable movable means is adjustably connected to said resistance mechanism by a set of universal joints and an axially slidable connection between said universal joints, one of said set of universal joints being connected to said rotatable shaft at said fixed location and the other of said set of universal joints being connected to said rotatable movable means.

6. The machine of claim 4 with the addition of adjustable elements within said rotatable movable means including means for positioning said user elements in angular relationship to said rotatable movable means in a plane parallel to the plane of said frame elements.

7. The machine of claim 6 wherein said means for positioning said user element includes spring means adapted to spring bias said user elements to direct connection to said rotatable movable means.

8. The machine of claim 7 wherein said spring biased means is a spline mechanism spring biased toward a direct spline connection between said user elements and said rotatable movable means.

9. The machine of claim 6 wherein said adjustable elements includes a lever arm adjustment for positioning said user elements in radial distance from the axis of rotation of said rotatable movable means.

10. The machine of claim 9 wherein said lever arm adjustment includes an arm fixable at the axis of rotation of said rotatable movable means, said lever arm adjustment providing an adjustment of said user elements slideably along said fixable arm into fixed positions with releasable locking positioning means.

* * * * *